US006806632B2

(12) United States Patent
Kim et al.

(10) Patent No.: US 6,806,632 B2
(45) Date of Patent: Oct. 19, 2004

(54) MASK IN COLOR CATHODE RAY TUBE

(75) Inventors: Sung Hun Kim, Pusan-shi (KR); Sung Yeon Kim, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 97 days.

(21) Appl. No.: 09/978,694

(22) Filed: Oct. 18, 2001

(65) Prior Publication Data

US 2002/0050777 A1 May 2, 2002

(30) Foreign Application Priority Data

Nov. 2, 2000 (KR) ..... 2000-64884

(51) Int. Cl.[7] ..... H01J 29/80
(52) U.S. Cl. ..... 313/403; 313/402
(58) Field of Search ..... 313/402, 403, 313/407

(56) References Cited

U.S. PATENT DOCUMENTS 5,856,725 A * 1/1999 Ueda ..... 313/402
6,614,154 B2 * 9/2003 Shin et al. ..... 313/403
2001/0050524 A1 * 12/2001 Choe et al. ..... 313/402

* cited by examiner

*Primary Examiner*—Ashok Patel
*Assistant Examiner*—Sharlene Leurig
(74) *Attorney, Agent, or Firm*—Birch, Stewart, Kolasch & Birch, LLP

(57) ABSTRACT

Shadow mask in a color cathode ray tube, including a plurality of slots for passing electron beams, and an open type bridge having a portion removed therefrom and dividing into slots in a vertical direction, wherein a difference 'Ti' of horizontal distances of an electron beam inlet edge and an electron beam outlet edge of the open type bridge formed near to vertical center line 'l' of the shadow mask is equal to, or greater than a difference 'To' of horizontal distances of an electron beam inlet edge and an electron beam outlet edge of the open type bridge formed far from a vertical center line 'l' of the shadow mask, thereby enhancing a luminance while open type bridges having an advantage over doming are maintained, and quality deterioration caused by view of bridge shadows coming from lengthened slots with a reduced number of bridges can be overcome.

5 Claims, 4 Drawing Sheets

MASK IN COLOR CATHODE RAY TUBE

BACKGROUND OF THE INVENTION

1. Field of the Invention

The present invention relates to a shadow mask in a cathode ray tube, and more particularly, to a shadow mask in a color cathode ray tube having an open type bridge no electron beam passes therethrough.

2. Background of the Related Art

As well known, the color cathode ray tube, one of electronic tubes, is a display used the most widely in many fields, starting from TV receivers and computer monitors to oscilloscopes and radar observation, and the like. The color cathode ray tube is called three color cathode ray tube, because a principle in which red, green, and blue colors are added together to reproduce a variety of colors. That is, three color fluorescent materials and three cathodes are used, and electron beams of electrons emitted from the cathodes are made to land on a screen having the three fluorescent materials coated thereon, for displaying a picture on the screen.

An exemplary related art color cathode ray tube having the shadow mask shown in FIGS. 1–3 employed therein will be explained. FIG. 1 illustrates a related art color cathode ray tube having a tension shadow mask schematically, FIG. 2 illustrates a plan view of a shadow mask, and FIG. 3 illustrates a section across a line B—B showing slots and an open type bridge of a shadow mask.

Referring to FIG. 1, the color cathode ray tube is provided with a substantially rectangular panel 1, a funnel 4 of a funnel shape fitted to the panel 2, an in-line type electron gun 10 having a cylindrical neck 6 fitted continuous to a small diametered end of the funnel 4 to form an outer appearance thereof, for emitting the electron beams 8. A bonding force of the panel 2 and the funnel 4 is enhanced by a reinforcing band 12, a fluorescent screen 13 having the three color fluorescent materials of emitting red, green, and blue lights respectively is provided on an inside surface of the panel 2, and the shadow mask 20 supported on a frame 16 fitted to the panel 2 through springs 14 is provided with a gap from the fluorescent screen 13. There is a deflection yoke 18 on an outer circumference of the funnel 4 in the vicinity of the neck 6, for producing a pin-cushion type horizontal magnetic field, and a barrel type vertical magnetic field, to deflect the electron beams 8 to all of the surface of the fluorescent screen 13, and an inner shield 19 fixed to the frame 16 for shielding the electron beams 8 from external geomagnetism enclosed under a high vacuum. Particularly, as shown in FIG. 2, the shadow mask 20 welded to the frame 16 on the inside surface of the panel 2 has a plurality of slots 22, forming openings, formed at fixed intervals in horizontal and vertical directions, and a bridge 24 between adjacent vertical slots 22.

Under this state, the electron beams 8 from the electron gun 10 is deflected at a large angle by the vertical and horizontal deflection magnetic field, and the deflected electron beams 8 are converged onto the plurality of slots 22 in the shadow mask 20. When the electron beams 13, color selected as the electron beams 13 pass through the slots 22, land onto the fluorescent screen 13, the three color fluorescent materials emit lights, to reproduce a color picture on the panel 2.

FIG. 3 illustrates a partial section of the shadow mask 20 showing the slots 22 and the open type bridges 24. The open type bridge 24 is formed by removing a portion of the bridge to make the bridge discontinuous.

As can be known from the section, the slot 22 for passing the electron beams has a tapered form inclusive of an inlet 222 for receiving the electron beams 8 from the electron gun 10, and an outlet 224 for letting the electron beams 8 to leave for the fluorescent screen 13, which is formed to have a greater area than the inlet 222, wherein a difference STi of horizontal distances of an inlet edge 222*a* and an outlet edge 224*a* of the slot 22, near to a vertical center line 'l' of the shadow mask 20, is smaller than a difference STo of horizontal distances the inlet edge 222*b* and the outlet edge 224*b* of the slot 22, far from the vertical center line 'l' of the shadow mask 20. The same is applicable to the open type bridge 24 wherein a difference 'Ti' of horizontal distances of an inlet edge 242*a* and an outlet edge 244*a* of the open type bridge 24, near to a vertical center line 'l' of the shadow mask 20, is also smaller than a difference To of horizontal distances the inlet edge 242*b* and the outlet edge 244*b* of the open type bridge 24, far from the vertical center line 'l' of the shadow mask 20. Sections of the slot 22 or the open type bridge 24 are formed to prevent distortion of the electron beams. For prevention of distortion of the electron beams, it is required to design the To and the STo shown in FIG. 4 to meet the following.

Referring to FIG. 4, with regard to the shadow mask 20 with a curvature, when it is assumed that 't' denotes a thickness of the shadow mask 20, 'α' denotes a deflection angle of the electron beams incident to the shadow mask 20, and 'β' denotes an angle of a normal vector to a surface to an axis of the cathode ray tube, To or STo can be expressed as follows;

$$To(\text{or } STo)=t\times\tan(\theta),\ \theta=\alpha-\beta,$$

A minimum value of STo or To that causes no distortion of the electron beams passing through the slot 22 or the open type bridge 24 of the shadow mask 20 can be calculated by above equation. Recently, of quality characteristics of the cathode ray tube, enhancement of the luminance values highly. For enhancing the luminance, it is required to lengthen the slot 22 for adjusting a transmissivity of the electron beams.

However, though the shadow mask with short slots and many number of bridges causes no problem with respect to vision as no shadows of the bridges are seen on the screen, the shadow mask with long slots and small number of bridges deteriorates a picture quality as shadows of the bridges are seen on the screen in forms of lines.

Only one horizontal slot may be provided removing the bridges entirely for eliminating such shadows of the bridges, when strength of the shadow mask is too weak to handle the shadow mask, and susceptible to vibration caused by external impact.

SUMMARY OF THE INVENTION

Accordingly, the present invention is directed to a shadow mask in a color cathode ray tube that substantially obviates one or more of the problems due to limitations and disadvantages of the related art.

An object of the present invention is to provide a shadow mask in a color cathode ray tube, which can enhance luminance while open type bridges having an advantage over doming are maintained, and quality deterioration caused by bridge shadows in view coming from lengthened slots with a reduced number of bridges can be overcome.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the shadow mask in a color cathode ray tube includes a plurality of slots for passing electron beams, and an open type bridge having a portion removed therefrom and dividing into slots in a vertical direction, wherein a difference 'Ti' of horizontal distances of an electron beam inlet edge and an electron beam outlet edge of the open type bridge formed near to a vertical center line 'l' of the shadow mask is equal to, or greater than a difference 'To' of horizontal distances of an electron beam inlet edge and an electron beam outlet edge of the open type bridge formed far from a vertical center line 'l' of the shadow mask.

A difference 'STo' of horizontal distances of an electron beam inlet edge and an electron beam outlet edge of the slot formed far from a vertical center line 'l' of the shadow mask is equal to, or greater than a difference 'STi' of horizontal distances of an electron beam inlet edge and an electron beam outlet edge of the slot formed near to a vertical center line 'l' of the shadow mask.

A maximum 'To' value of the open type bridge meets the following equation.

$$\mathrm{Max}(To)=t\times\tan(\theta),$$

Where, $\theta=\alpha-\beta$, $\alpha$=a deflection angle of the electron beams, t=a thickness of the shadow mask, and $\beta$=an angle of a normal vector to a mask surface to a cathode ray tube axis.

In another aspect of the present invention, there is provided a shadow mask in a color cathode ray tube including a plurality of slots for passing electron beams, and an open type bridge having a portion removed therefrom and dividing into slots in a vertical direction, wherein an angle '$\lambda$' between a line connecting a center of the electron beam inlet and a center of the electron beam outlet of the open type bridge to a horizontal plane is not greater than a deflection angle '$\alpha$' of the electron beams.

In further aspect of the present invention, there is a shadow mask in a color cathode ray tube including a plurality of slots for passing electron beams, and an open type bridge having a portion removed therefrom and dividing into slots in a vertical direction, wherein an amount of taper 'Ti' formed at a location near to a vertical center line of the shadow mask is equal to, or greater than an amount 'To' of taper formed at a location far from the vertical center line of the shadow mask.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
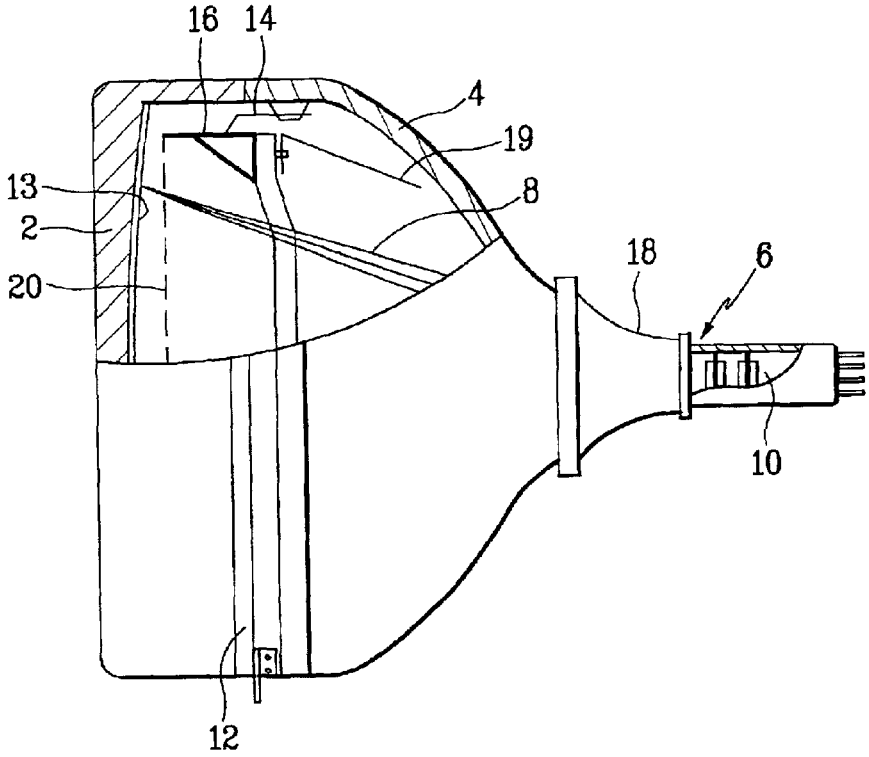
FIG.1 Related Art
FIG. 1 illustrates a related art color cathode ray tube having a tension shadow mask schematically.
Figure 2:
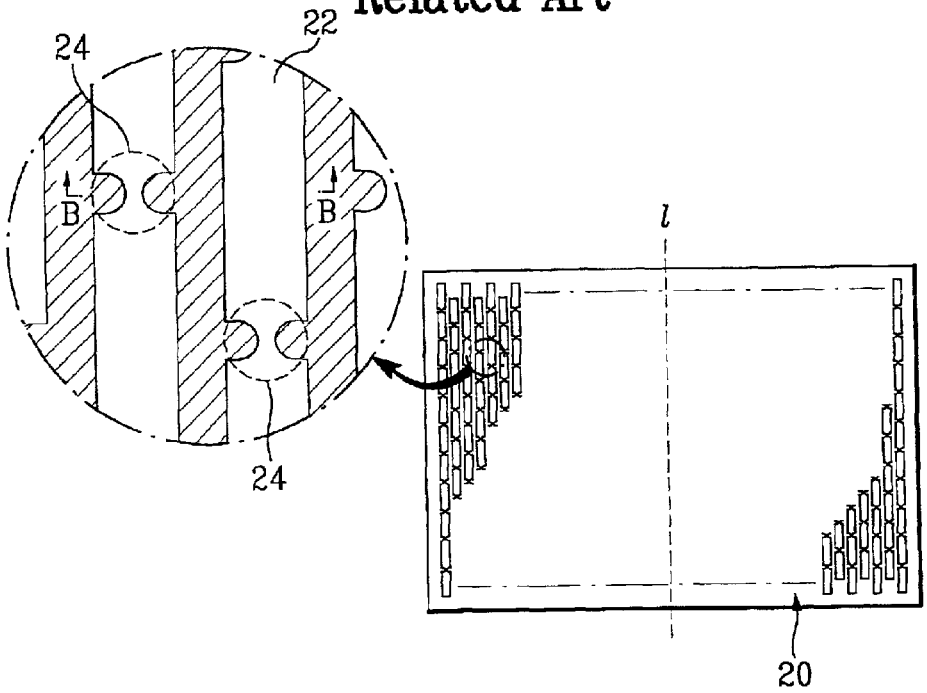
FIG.2 Related Art
FIG. 2 illustrates a plan view with a partial enlarged view of a shadow mask.
Figure 5:
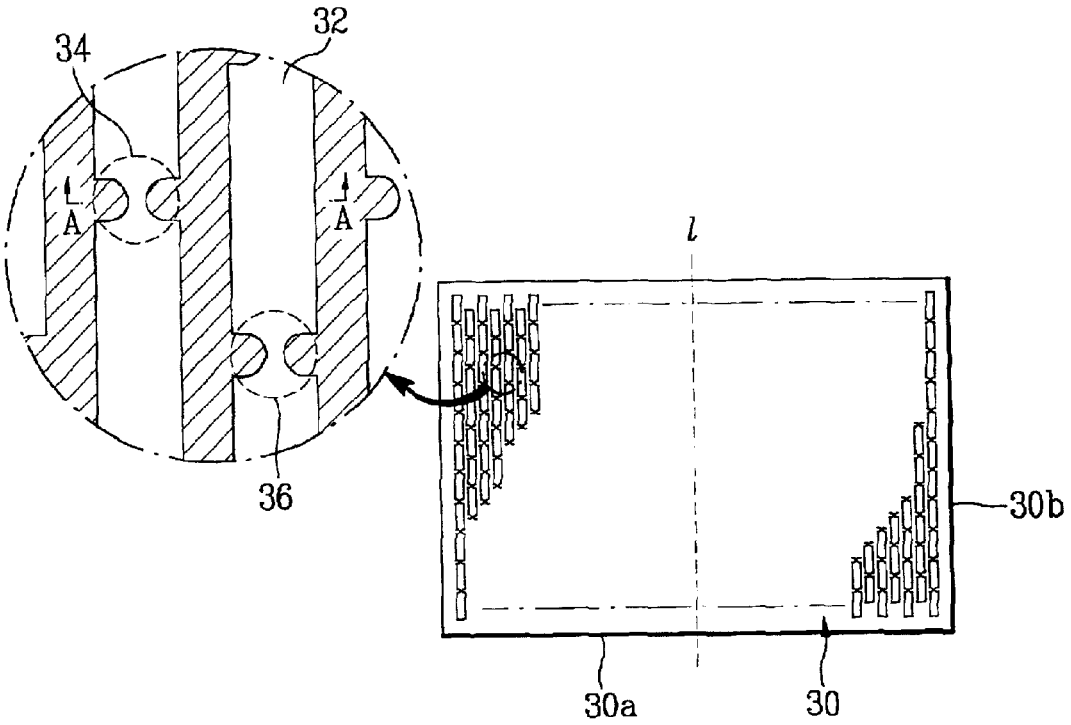
FIG. 5 illustrates a plan view with a partial enlarged view of a shadow mask in a color cathode ray tube in accordance with a preferred embodiment of the present invention.
Figure 6:
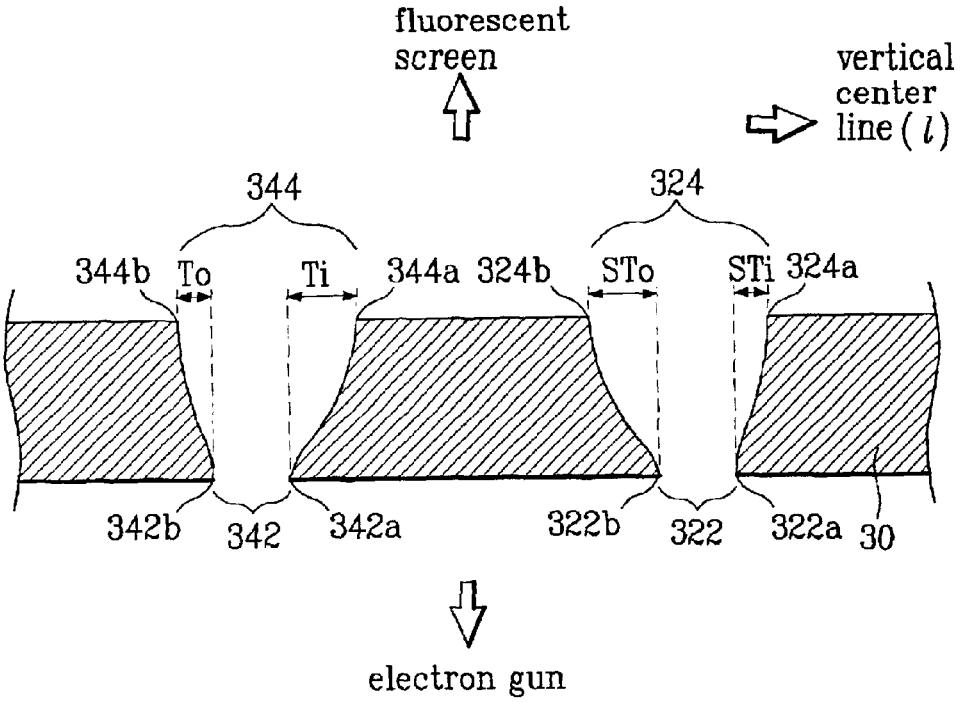
FIG. 6 illustrates a section across a line A—A in FIG. 1 showing slots and an open type bridge of a shadow mask; and, FIG. 7 illustrates a section of an open type bridge of a shadow mask in a color cathode ray tube in accordance with another preferred embodiment of the present invention.

Reference will now be made in detail to the preferred embodiments of the present invention, examples of which are illustrated in the accompanying drawings. For reference, it will be noted that parts identical to the related art will be given the same reference symbols for avoiding duplication. FIG. 5 illustrates a plan view with a partial enlarged view of a shadow mask in a color cathode ray tube in accordance with a preferred embodiment of the present invention, and FIG. 6 illustrates a section across a line A—A in FIG. 1 showing slots and an open type bridge of a shadow mask.

Figure 3:
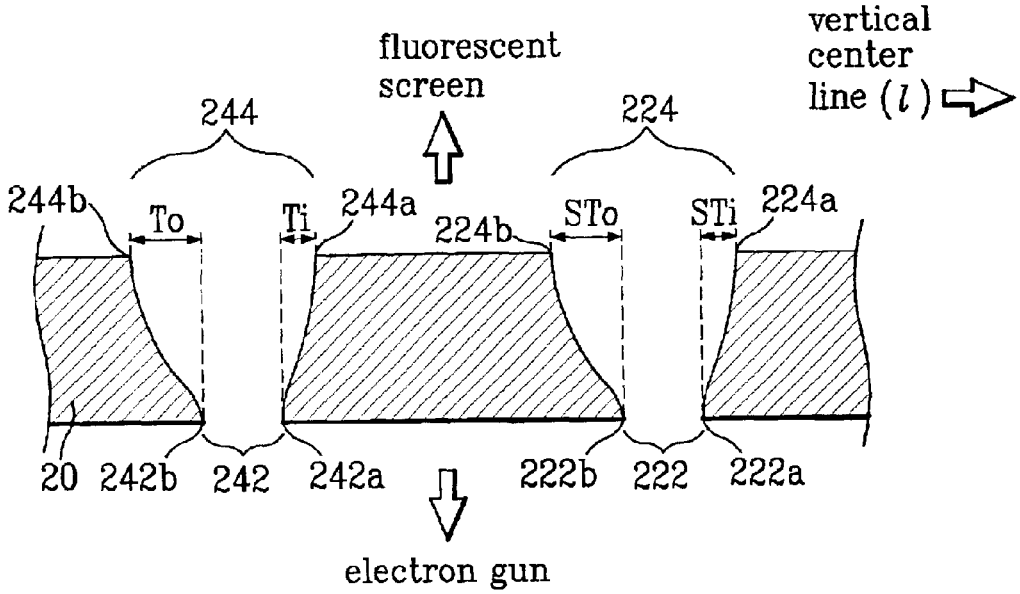
FIG. 3 Related Art
FIG. 3 illustrates a section across a line B—B in FIG. 2 showing slots and an open type bridge of a shadow mask.
Figure 4:
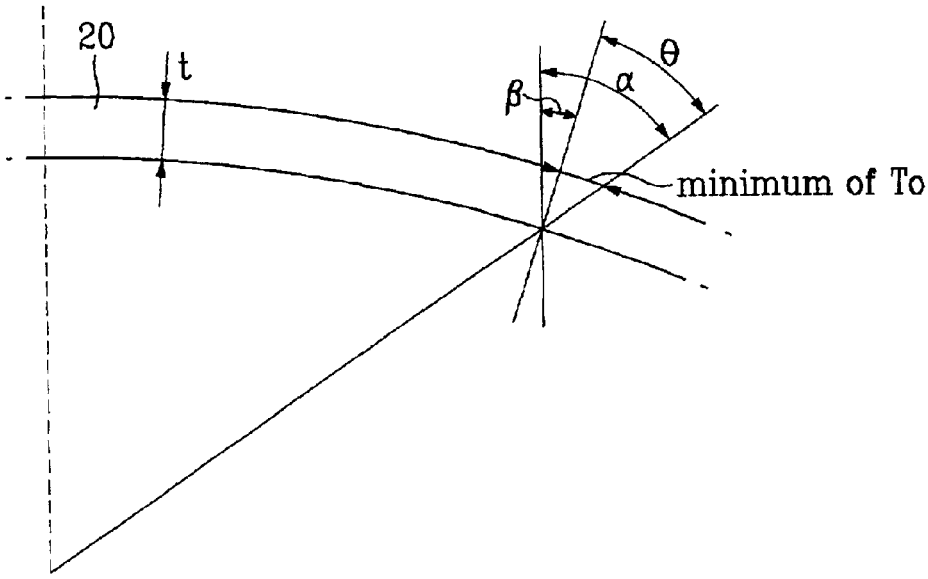
FIG. 4 Related Art
FIG. 4 illustrates a relation of a deflection angle of an electron beam and 'To' of open type bridge.

Referring to FIG. 5, the shadow mask 30 in a substantially rectangular form with long sides 30*a* and short sides 30*b* includes a plurality of slots 32 of openings, and open type bridges 34 between the slots 32. The slots 32, electron beam pass through holes for passing the electron beams emitted from the electron gun (see FIG. 1) in the cathode ray tube, serves the electron beams to hit onto the fluorescent screen on the panel (see FIG. 1) spaced from the shadow mask 30 in rear thereof. The shadow mask 30 is thin plate of, in general, an alloy with a low heat expansion coefficient, such as invar steel. The slot 30 in the shadow mask 30 has bridges 34 at fixed intervals. As shown, the bridge 34 of the present invention is of open type having a cut away center portion. As explained in association with the related art, the open type bridge 34 is favorable for doming occurred owing to temperature rise of the shadow mask 30 caused by the electron beam hitting on the shadow mask 30, introduced for solving mislanding of the electron beams. Cross sections of the slots and the open type bridges have tapered sections. Alike the related art (see FIG. 3), the section of the slot 32 shown in FIG. 6 has an inlet 322 for reception of the electron beams, and an outlet 324 for letting the electron beams to leave for the fluorescent screen, which is formed to have a greater area than the inlet 322, for preventing the electron beams from hitting an inside wall of the slot 32 by widening the area of the outlet as the electron beams is deflected the farther toward the periphery of the screen by the deflection yoke at the outlet 324 (see FIG. 1) as the slot 32 is located the closer to the periphery of the screen.

When it is assumed that a difference of horizontal distances of an electron beam inlet edge 322*a* and an electron beam outlet edge 324*a* of the slot 32 near to a vertical center line of the shadow mask 30 STi, and a difference of horizontal distances of an electron beam inlet edge 322*b* and an electron beam outlet edge 324*b* of the slot 32 far from the vertical center line of the shadow mask 30 is STo, STi and STo satisfy the following condition.

$$\mathrm{STo}\geqq\mathrm{STi}$$

That is, the slot 32 in the shadow mask 30 has an amount of taper formed at a location far from the vertical center line is equal to or greater than the amount of taper at a location near to the vertical center line. On the other hand, as shown in FIG. 6, it can be known that the section of the open type bridge 34 is opposite to a form of the slot 32. When it is assumed that a difference of horizontal distances of an electron beam inlet edge 342*a* and an electron beam outlet edge 344*a* of the of the open type bridge 34 formed near to a vertical center line of the shadow mask 30 is Ti, and a difference of horizontal distances of an electron beam inlet edge 342*b* and an electron beam outlet edge 344*b* of the open type bridge 34 formed far from the vertical center line of the shadow mask 30 is To, Ti and To satisfy the following condition.

Ti≧To

That is, the open type bridge 34 in the shadow mask 30 has an amount of taper formed at a location near to the vertical center line is equal to or greater than the amount of taper at a location far from the vertical center line.

The foregoing open type bridge 34 is designed such that the deflected electron beam can not pass through the opening in the open type bridge 34 based on the minimum value equation of 'STo' and 'To' explained in association with the related art. By employing the foregoing open type bridge 34, the shadow mask 30 is made to have a structure favorable for doming caused by thermal expansion, that causes misland-ing of the electron beams, while an effect that there is a bridge can be provided on the screen as the electron beams can not pass through opening in the open type bridge.

Figure 7:
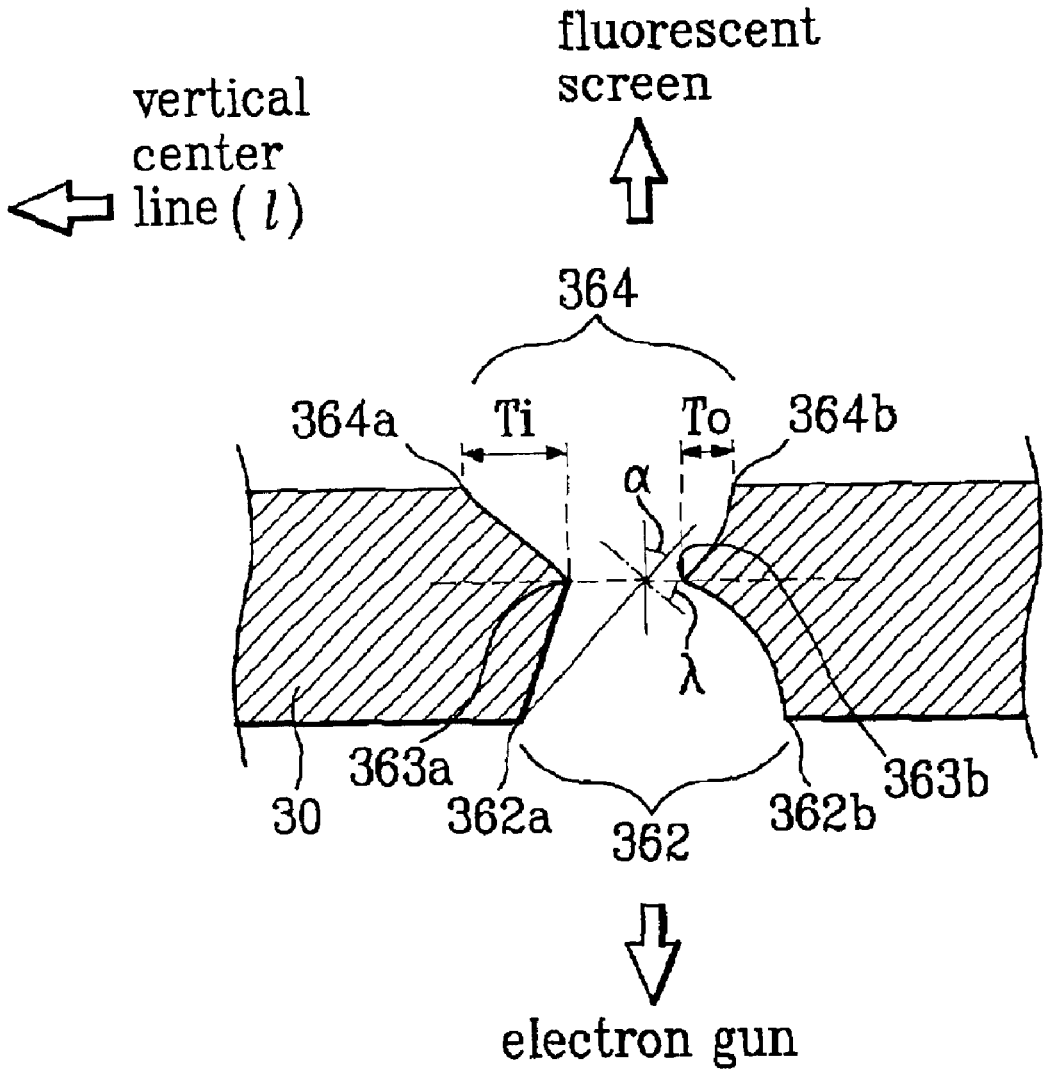

FIG. 7 illustrates a section of an open type bridge of a shadow mask in a color cathode ray tube in accordance with another preferred embodiment of the present invention. Since the slot has a structure identical to the slot shown in FIG. 6, the slot is omitted in FIG. 7.

Referring to FIG. 7, the open type bridge 36 has tapers formed on both sides of a horizontal center line of the section. That is, there is a minimum area part 363 which has an area smaller than both of the inlet 362 and outlet 364 formed between the inlet 362 and the outlet 364. For achieving a basic object of the present invention, it is required that an area of the electron beam inlet 362 is larger than an area of the electron beam outlet 364. In the present invention, an amount of taper 'Ti' near to the vertical center line of the shadow mask 30 denotes a difference of horizontal distances of an edge 363*a* of a minimum area part 363 and an electron beam outlet edge 364*a*, and an amount of taper 'To' far from the vertical center line of the shadow mask 30 denotes a difference of horizontal distances of an edge 363*b* of a minimum area part 363 and an electron beam outlet edge 364*b*. Different from the embodiment explained in association with FIG. 6, 'Ti' and 'To' may have a correlation varied with an amount of taper from the electron beam inlet 362 to the minimum area part 363 of the open type bridge 36.

An electron beam deflection angle and a form of open type bridge for achieving the object of the present invention will be explained.

In the embodiment, 'λ' denotes an angle between a line connecting a center of the electron beam outlet 364 and a center of the electron beam inlet 362 and a horizontal plane, and 'α' denotes an angle of the electron beams deflected with respect to a tube axis of the cathode ray tube, it is required that the 'λ' is not greater than the 'α'. ('λ'≦'α') If 'λ' is equal to the electron beam deflection angle 'α', a case 'λ' is perpendicular to 'α', the electron beam can not pass through the minimum area part 363, as an incident electron beam, not reaches to the screen, but is reflected again, and, if 'λ' is smaller than the electron beam deflection angle 'α', the electron beam incident to the open type bridge 36 can not reaches to the screen, as the electron beam can not cross over the center line, but is reflected again.

As has been explained, the shadow mask in a color cathode ray tube of the present invention has the following advantages.

While the open type bridge that is advantageous for doming is maintained as it was, the open type bridge is formed such that no electron beams can pass through the open type bridge to permit elongation of a slot length, thereby making bridge shadow not to be sensed and improving a screen luminance, even if a fewer number of the open type bridges are formed.

It will be apparent to those skilled in the art that various modifications and variations can be made in a shadow mask in a color cathode ray tube of the present invention without departing from the spirit or scope of the invention. Thus, it is intended that the present invention cover the modifications and variations of this invention provided they come within the scope of the appended claims and their equivalents.

What is claimed is:

1. A shadow mask in a color cathode ray tube, comprising:

a plurality of slots for passing electron beams; and, an open type bridge having horizontal portions extending toward each other from sides of said slots, but being discontinuous for dividing slots in a vertical direction, wherein a difference 'Ti' of horizontal distances of an electron beam inlet edge and an electron beam outlet edge of the open type bridge formed near to a vertical center line 'l' of the shadow mask is equal to, or greater than a difference 'To' of horizontal distances of an electron beam inlet edge and an electron beam outlet edge of the open type bridge formed far from a vertical center line 'l' of the shadow mask.

2. A shadow mask as claimed in claim 1, wherein a difference 'STo' of horizontal distances of an electron beam inlet edge and an electron beam outlet edge of the slot formed far from a vertical center line 'l' of the shadow mask is equal to, or greater than a difference 'STi' of horizontal distances of an electron beam inlet edge and an electron beam outlet edge of the slot formed near to a vertical center line 'l' of the shadow mask.

3. A shadow mask as claimed in claim 1, wherein a maximum 'To' value of the open type bridge meets the following equation, $$\mathrm{Max}(To)=t\times\tan(\theta),$$

Where, $\theta=\alpha-\beta$, $\alpha$=a deflection angle of the electron beams incident to the shadow mask, t=a thickness of the shadow mask, and $\beta$=an angle of a normal vector to a mask surface to a cathode ray tube axis.

4. A shadow mask in a color cathode ray tube, comprising:

a plurality of slots for passing electron beams; and, an open type bridge having horizontal portions extending toward each other from sides of said slots, but being discontinuous for dividing slots in a vertical direction, wherein an angle 'λ' between a line connecting a center an the electron beam inlet and a center of an electron beam outlet of the open type bridge to a horizontal plane is not greater than a deflection angle 'α' of the electron beams incident to the shadow mask.

5. A shadow mask in a color cathode ray tube, comprising:

a plurality of slots for passing electron beams; and, an open type bridge having horizontal portions extending toward each other from sides of said slots, but being discontinuous for dividing slots in a vertical direction, wherein an amount of taper 'Ti' of the open type bridge formed at a location near to a vertical center line of the shadow mask is equal to, or greater than an amount 'To' of taper formed at a location far from the vertical center line of the shadow mask.

* * * * *